US005307969A

United States Patent [19]

Menendez

[11] Patent Number: 5,307,969

[45] Date of Patent: May 3, 1994

[54] BAG DISPENSING APPARATUS

[76] Inventor: Vincent M. Menendez, 14003 Lake Magdalene Blvd., Tampa, Fla. 33618

[21] Appl. No.: 982,592

[22] Filed: Nov. 27, 1992

[51] Int. Cl.[5] ..... B26F 3/02

[52] U.S. Cl. ..... 225/42; 225/52; 225/77; 225/106

[58] Field of Search ..... 225/42, 49, 52, 77, 225/90, 91, 106; 206/409, 389, 461, 468, 467

[56] References Cited

U.S. PATENT DOCUMENTS

| | | | |
|---|---|---|---|
| 2,253,744 | 8/1941 | Witt | 225/42 |
| 2,657,873 | 11/1953 | Dittman et al. | 225/42 |
| 2,943,777 | 7/1960 | Dvoracek | 225/38 |
| 3,679,146 | 7/1972 | Klitzke | 206/409 |
| 3,930,697 | 1/1976 | Barouh et al. | 225/53 |
| 4,179,055 | 12/1979 | Milner | 225/91 |
| 4,424,926 | 1/1984 | Gatward | 225/90 |
| 4,535,912 | 8/1985 | Bonk | 225/106 |
| 5,188,022 | 6/1992 | Farahnik | 225/106 |

*Primary Examiner*—Hien H. Phan
*Attorney, Agent, or Firm*—Michael J. Colitz, Jr.

[57] ABSTRACT

A system for facilitating the sequential dispensing of individual bags from a roll comprising a roll of bags, the bags being formed together in a roll, each bag having perforations along the leading edge to facilitate its separation from the next following bag and an elongated slit centrally located between the perforations, a dispenser for receiving and supporting the roll of bags comprising a housing of a generally semi-cylindrical configuration, the housing having an interior end and an exterior end, a transverse opening formed in the housing at its interior end, a transverse slot formed in the housing at its exterior end, with the transverse slot separating the housing into an upper portion and a lower portion, lips formed in the upper portion and the lower portion of the housing on opposite sides of the slot with the lips being in a curvature in a direction opposite from the curvature of the remainder of the housing, a finger formed in the center of the slot extending upwardly from the lower portion adapted to receive a slit in the region between adjacent bags, a recess formed in the center of the slot extending upwardly in the upper portion of the housing adapted to receive the finger, and flanges extending outwardly from the dispenser adjacent to the transverse opening and a bracket adapted to receive and support the dispenser.

6 Claims, 3 Drawing Sheets

FIG. 5
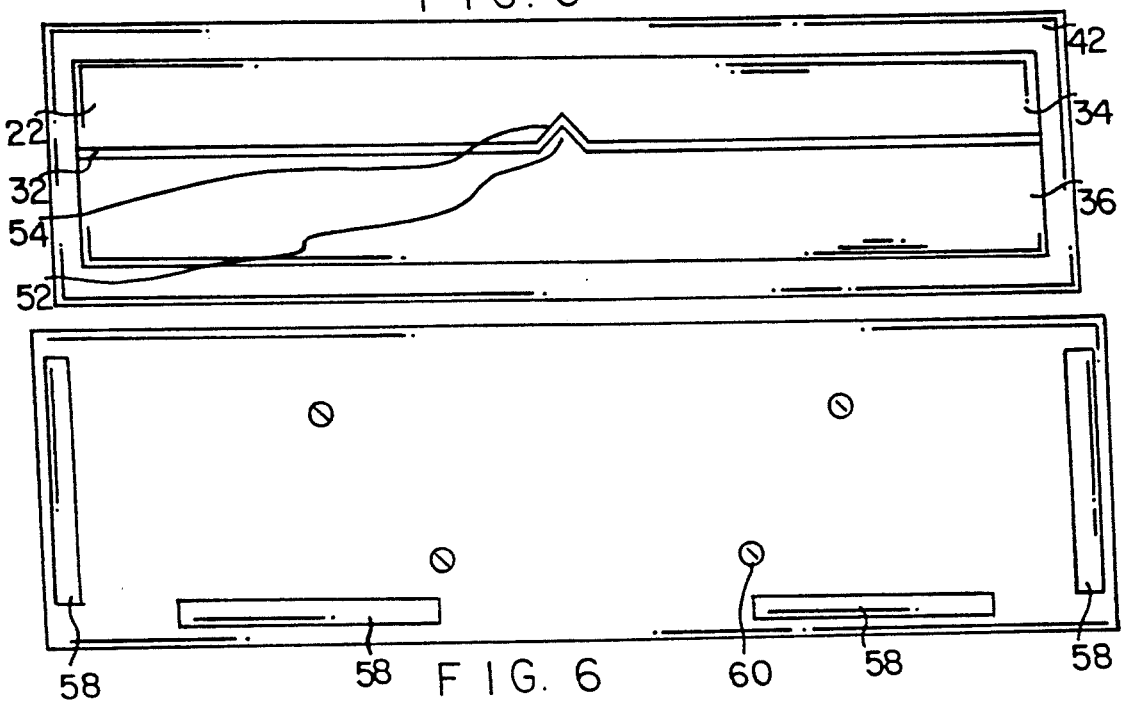
FIG. 6
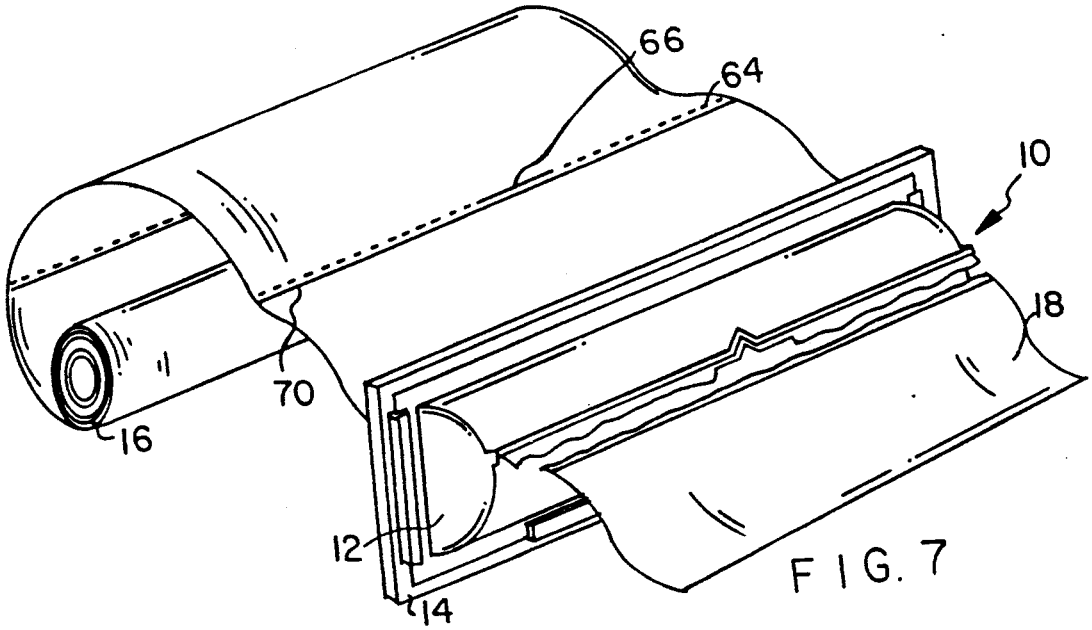
FIG. 7

BAG DISPENSING APPARATUS

FIELD OF THE INVENTION

This invention relates to bag dispensing apparatus and, more particularly, to a system for facilitating the sequential dispensing of individual bags from a roll, the system comprising a dispenser, a bracket for supporting the dispenser and a roll of bags to be dispensed.

BACKGROUND OF THE INVENTION

Red infectious waste bags are in common use today. Red infectious waste bags, readily identifiable because of their distinctive color, are plastic bags found at central locations throughout hospitals or other health-care sites. They are used for the disposal of infectious waste so as to maximize sanitation in and around hospitals or the like. When any such bag is filled, it must be promptly removed and disposed of appropriately and a new bag placed at the location of the removed bag for future use. In order to insure the use of such bags, their convenience must be enhanced to the maximum.

The present technology has no system or technique for the quick, simple, convenient and cost effective removal of a single red infectious waste bag from a supply. As a result, the chances of a person removing a filled bag and not replacing it with a red bag are increased. This increases the possibility that the absence of such a bag at its location will result in a health care worker disposing of infectious waste in a container not intended for such infectious waste. Nonsanitary results could result.

Another shortcoming of the present technology is that red infectious waste bags in use today are normally very large and located at a limited number of centralized locations. As a result, there is an increase in the frequency of people utilizing such bags for deposits of noninfectious material which causes increased costs for sanitized disposal of the red bags which contain noninfectious materials. In contrast to this, the present invention contemplates a larger number of smaller bags located at a larger number of locations throughout a health care facility to maximize their use, increase their convenience, discourage use for other than infectious waste, etc., all with increased efficiency and cost effectiveness.

Bags in roll forms are in wide use today. Consider, for example, sandwich bags found in many home kitchens today. Such bags are roll form with perforations evenly across the opening of the bag being pulled off the roll. Heat sealing along the three sides remote from the opening couples the upper and lower faces of the plastic forming each bag. Also known are bags used to cover clothes at commercial laundries. Such laundry bags are similar to sandwich bags except that they are much larger. They are supported in roll form at an elevated location. Their lower ends are opened for being pulled down over the clothes to be bagged. Their upper ends are perforated at the sides with a central slit through which the hanger passes. Such techniques for dispensing bags from a roll require the user to use two hands, an inconvenience to the user.

A further variation of bag dispensing from a roll is found in a system commercially available from the Rhinox Corporation. Such system includes bags in roll form with a dispenser to support such roll and to facilitate the sequential dispensing of individual bags from its dispenser. Such system has a slot formed in the dispenser with a finger and associated recess formed in the adjacent edges of the dispenser slot. The finger and recess cooperate to separate each bag from the next adjacent bag as it is being dispensed. The finger and recess cooperate with a slit at the center of the adjacent bags between perforations on opposite sides of the slit. Such system is deployed vertically during operation and use, a design defect rendering the system of less convenience and reliability.

One last variation of bag dispensing from a roll is found in a system commercially available in Europe. Such system includes bags in roll form with a dispenser to support such roll and to facilitate the sequential dispensing of individual bags. Such dispenser is in the form of a wall-mounted quarter cylinder. The quarter cylinder has a finger extending forwardly from the leading lower edge of the dispenser. The finger functions to separate each bag from the next adjacent bag as it is being dispensed. The finger cooperates with a slit at the center of the adjacent bags between perforations on opposite sides of the slit. Such system has an open top rendering it less than acceptable in terms of sanitation.

Prior art patents relating to more conventional dispensers are disclosed in U.S. Pat. No. 3,481,112 to Bourgeois and U.S. Pat. No. 3,858,382 to Suominen as well as U.S. Design Pat. Nos. 297,415 to Gavin; No. 304,136 to Severini; and No. 325,311 to Mygind.

Accordingly, it is an object of the present invention to provide an improved system for facilitating the sequential dispensing of individual bags from a roll comprising a roll of bags, the bags being formed together in a roll, each bag having perforations along the leading edge to facilitate its separation from the next following bag and an elongated slit centrally located between the perforations, a dispenser for receiving and supporting the roll of bags comprising a housing of a generally semi-cylindrical configuration, the housing having an interior end and an exterior end, a transverse opening formed in the housing at its interior end, a transverse slot formed in the housing at its exterior end, with the transverse slot separating the housing into an upper portion and a lower portion, lips formed in the upper portion and the lower portion of the housing on opposite sides of the slot with the lips being in a curvature in a direction opposite from the curvature of the remainder of the housing, a finger formed in the center of the slot extending upwardly from the lower portion adapted to receive a slit in the region between adjacent bags, a recess formed in the center of the slot extending upwardly in the upper portion of the housing adapted to receive the finger, and flanges extending outwardly from the dispenser adjacent to the transverse opening and a bracket adapted to receive and support the dispenser.

It is a further object of the present invention to dispense bags in a more simple, convenient, quick and cost effective manner.

It is a further object of the present invention to separate bags from a roll one-handedly.

It is a further object of the present invention to utilize a finger and recess in a slot of a bag dispenser apparatus which, in cooperation with a slit between adjacent bags of a roll, ensures proper separation of the individual bags being dispensed.

It is a further object of the present invention to construct bag dispensers with reverse curves adjacent to the output slot to maintain the leading edge of the following bag in position for subsequent removal.

It is a further object of the present invention to position the lower half of an output slot more outwardly than the upper half to ease loading, threading, and separation of bags to be dispensed therefrom.

It is a further object of the present invention to promote the sanitation in hospitals and other health care facilities for patients, workers, visitors, etc.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying claims.

SUMMARY OF THE INVENTION

The invention is defined by the appended claims with specific embodiments shown on the attached drawings. For the purpose of summarizing this invention, the invention may be incorporated into an improved system for facilitating sanitation in a hospital comprising a roll of red infectious bags, the bags being fabricated of a plastic material into an essentially identical configuration and formed together in a roll with each bag having a leading edge to be pulled from the roll, the leading edge constituting the top of the bag when used, each bag also having a trailing edge with the trailing edge constituting the bottom of the bag when used, perforations along the trailing edge of each bag to facilitate the one-handed separation of each bag from the next following bag, and an elongated slit centrally located between the perforations to restrain the pulling of the next adjacent bag, each bag having lateral edges with a heat seal line therebetween, a dispenser for supporting, dispensing and separating individual bags from the roll of bags comprising a rigid housing molded of a polymeric material in a one-piece, generally semi-cylindrical configuration, the housing having an interior end and an exterior end; a transverse opening formed in the housing at the interior adapted to allow loading a roll of bags into the interior of the housing, a transverse slot formed in the housing at the exterior end adapted to allow the dispensing of individual bags therethrough from the roll of bags from the interior of the housing to exterior thereof, the transverse slot separating the housing into an upper portion and the lower portion, end caps at the lateral ends of the slot to couple the upper portion and a lower portion, flanges in a plane extending downwardly and outwardly from the end caps and the upper and lower portions for removably securing the housing to a vertical support structure, lips formed in the upper portion and the lower portion of the housing on opposite sides of the slot, the lips being in a curvature in a direction opposite from the curvature of the remainder of the housing to guide the movement of individual bags through the slot, a finger formed in the center of the slot extending upwardly from the lower portion of the housing adapted to receive the slit in the bag at the region between adjacent bags to be separated, and a recess formed in the center of the slot extending upwardly in the upper portion of the housing adapted to receive the finger to assist in the separating of adjacent bags being dispensed and a bracket having holes for mounting on a wall and outstanding supports at the lateral edges and across the bottom thereof for receiving the flanges and supporting the dispenser.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIGS. 5 and 6 are front elevational views of the dispenser and bracket of FIG. 1.

FIG. 7 is an exploded perspective view of the hardware of FIG. 1 but also showing a roll of bags and a bag being dispensed.

Similar reference characters refer to similar parts throughout the several views of the drawings.

DETAILED DESCRIPTION OF THE PREFERRED EMBODIMENT

Figure 1:
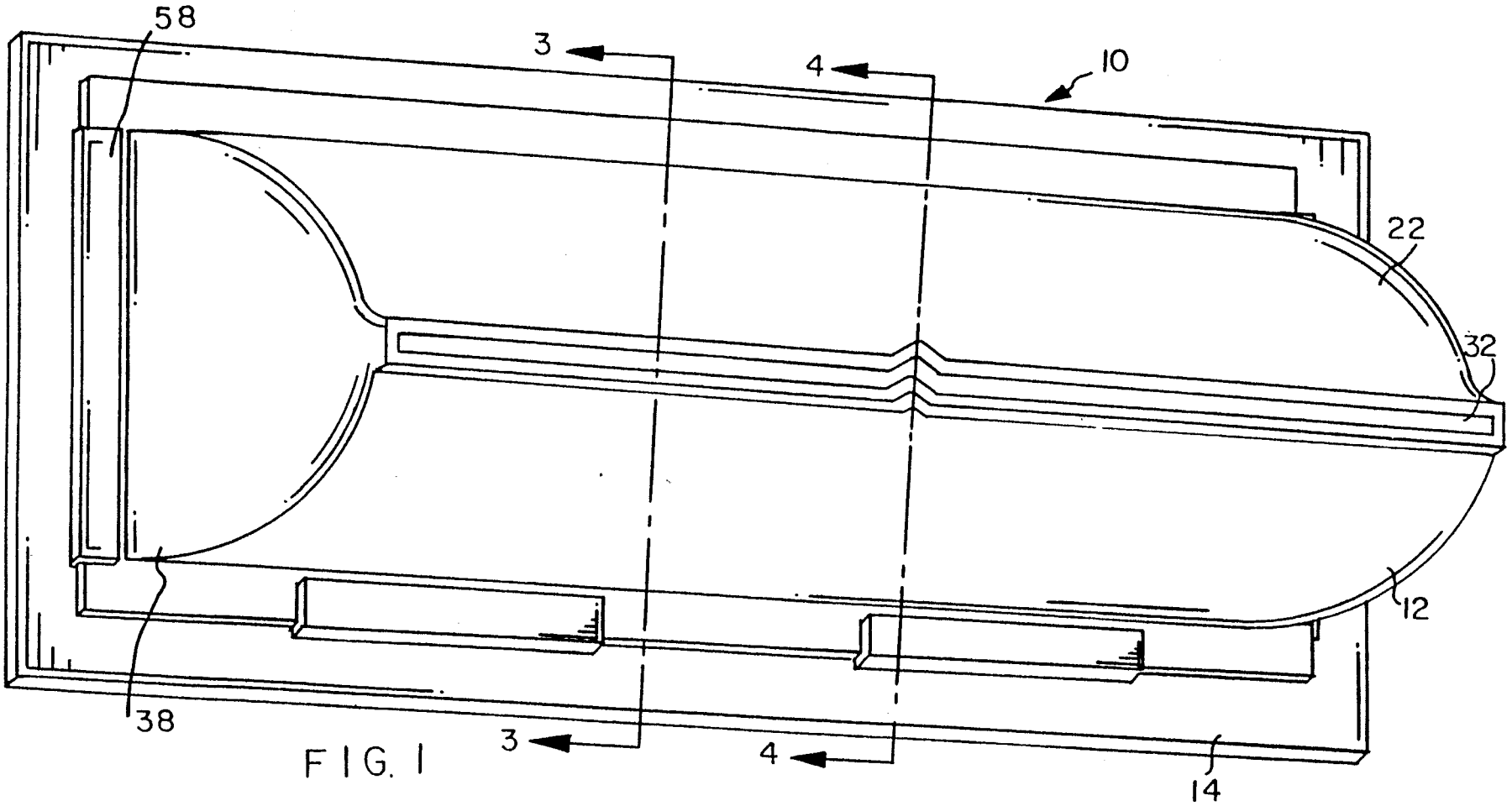
FIG. 1 is a perspective illustration of a dispenser and bracket constructed in accordance with the principles of the present invention.

Shown from the various Figures is a system 10 for facilitating sanitation in a hospital or other health care facility. The system in its broadest context includes a dispenser 12, a bracket 14 for supporting the dispenser on a wall, and the bags from a roll of bags 16 to be dispensed. The dispenser and bracket constitute the hardware for the system.

The dispenser is adapted to support, dispense, and separate individual bags 18 from a roll of bags 16 contained within the dispenser. The dispenser comprises a rigid housing 22 preferably molded of a polymeric material such as polystyrene or the like. It is of a one-piece construction in a generally semi-cylindrical configuration. The housing has an interior end 24 and an exterior end 26. A transverse opening 28 is located at the interior end and is adapted to allow the loading of a roll of bags 16 from the interior thereof. The opening is opened when the dispenser is lifted out of the bracket 14.

A transverse slot 32 is formed in the housing at the exterior end. The slot is adapted to allow the dispensing of individual bags 18 from the roll of the bags from the interior of the housing to exterior thereof. The transverse slot 32 separates the housing into an upper portion 34 and a lower portion 36. End caps 38 are located in the upper and lower portions at the lateral ends of the housing and slot to couple the upper portion and the lower portion.

Figure 4:
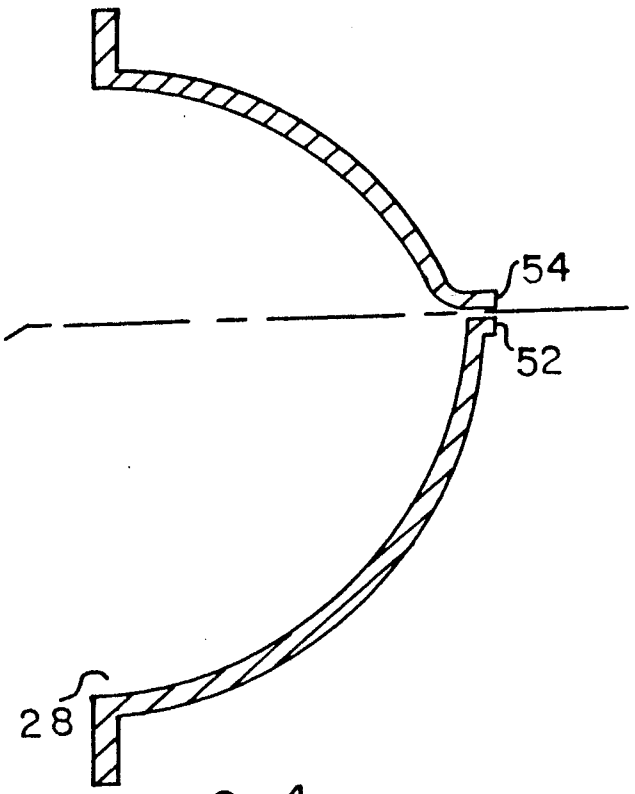
FIGS. 3 and 4 are sectional views taken along lines 3—3 and 4—4 of FIG. 1.
Figure 3:
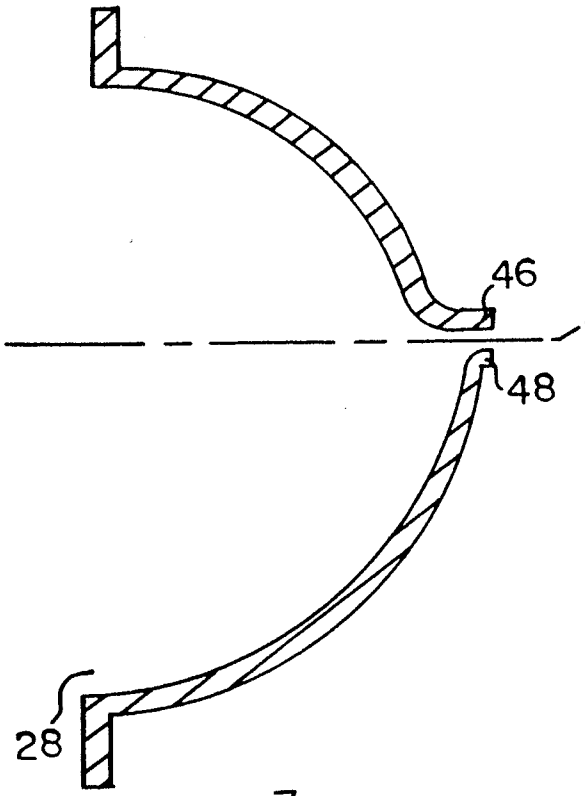
Figure 2:
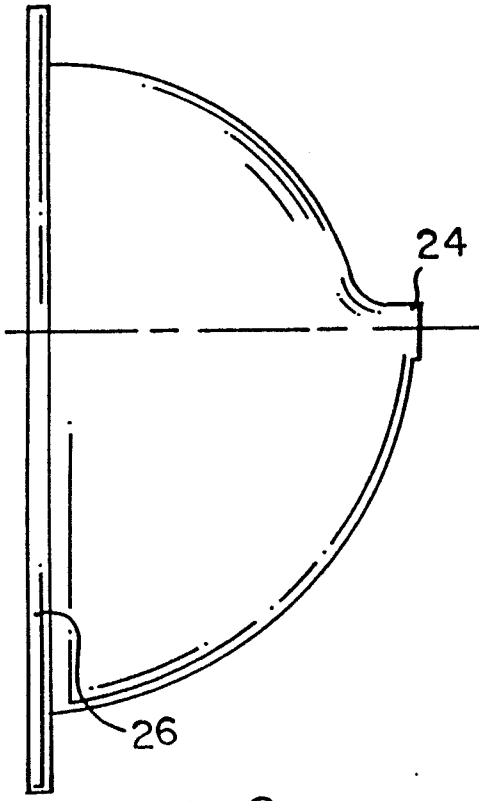
FIG. 2 is an end elevational view of the hardware shown in FIG. 1.

In a plane of the interior opening are flanges 42 which extend in a plane upwardly and downwardly from the lower inside edge of the housing and outwardly from the lateral inside edges. The flanges provide rigidity to the housing and also allow for the removable securement of the housing 22 to the bracket, a vertical support structure. The radius and curvature of the upper portion 34 is slightly less than the radius of curvature of the lower portion 36 when viewed through a vertical plane through the dispenser. Note FIGS. 2, 3 and 4. This allows the upper edge of the lower portion 36 to protrude outwardly from the slot 32 to a greater distance than the lower edge of the upper portion 34.

The adjacent portions of the housing form the lips 46 and 48 which are curved outwardly in a duck-billed configuration, opposite from the radius of curvature of the major extents of the upper and lower portions of the housing. This outward curving of the lips allow for the easy and smooth flow of bags through the slot, the easy loading of the first bag through the slot and the convenient positioning of the next following bag to be grasped and dispensed.

The slot 32 includes a triangularly shaped finger 52 extending upwardly from the upper edge of the lower portion 36 and a cooperable recess 54 cooperable with the finger to separate the dispensed bag from the roll. The finger and recess and the shape of the housing are responsible for the finger a32Xaedess to be at the farthest point away from the interior of the dispenser. This insures that the leading edge of the bag to be next dispensed will remain outside the dispenser and render it easy to grasp the next subsequent bags during operation and use. A slight stretching of the bags when separated from the roll further facilitates grasping of the next following bag. This overall arrangement also insures that the system will separate bags in a continuous cycle of operation and use. In addition, this arrangement helps in eliminating bags from sliding back into the cylinder.

The bracket 14 is a single plate with outstanding supports 58. The outstanding supports extend outwardly from the plate and then turn inwardly for supporting the flanges of the dispenser. Such supports are located at opposite sides for receiving the lateral flanges 42 of the dispenser to preclude lateral shifting. A pair of spaced lower flanges allow for supporting the container in an appropriate elevational position. Apertures 60 in the plate allow for vertically securing the bracket to a wall or the like through screws.

The bags 18 are in roll form, each of an essentially identical construction, and are provided with perforations 64 extending from edge to edge for easily separating adjacent bags of the roll. In the center of the bag between the perforations is a slit 66, perforations 68 on the opposite sides thereof, and a heat seal line 70 defining the bottom of each dispensed bag. The slit 66 is adapted to be received by the finger 52 to assist in the separation thereof. Consequently, when a bag is pulled forwardly from the slot 32 of the dispenser 12, the finger 52 will extend upwardly through the slit 66 in the center portion of adjacent bags 18. Additional pulling downwardly will effect separation of the bag at the perforations along its entire extent while, at the same time, will function to preclude the next adjacent bag from being pulled through. This is because of the existence of the finger in the slot 66 which functions as a barrier. The pulling force on the dispensed bag will also stretch the next adjacent bag on the roll to position it for being dispensed when desired.

Such bags 18 are preferably fabricated of polyethylene, high density or low density. Such bags, due to material selection, when used in association with such dispenser, allows the next subsequent bag to be stretched to outside the dispenser to a limited extent when a bag is pulled and separated. The bags 18 may be of a width slightly less then the width of the dispenser 12 and slot 32. It is preferred, however, that the bags be nearly twice as wide with their edges folded under so that the entire bag, except at the slit 66, is of double thickness. After dispensing the bag is unfolded for use.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A system for facilitating sanitation in a hospital comprising:

a roll of red infectious bags, the bags being fabricated of a plastic material into an essentially identical configuration and formed together in a roll with each adjacent bag having a leading edge to be pulled from the roll, the leading edge constituting the top of the bag when used, each bag also having a trailing edge with the trailing edge constituting the bottom of the bag when used, perforations along the trailing edge of each bag to facilitate the one-handed separation of each bag from the next following bag, and an elongated slit centrally located between the perforations to restrain the pulling of the next adjacent bag, each bag having lateral edges with a heat seal line therebetween;

a dispenser for supporting, dispensing and separating individual bags from the roll of bags comprising a rigid housing molded of a polymeric material in a one-piece, generally semi-cylindrical configuration, the housing having an interior end and an exterior end; a transverse opening formed in the housing at the interior end adapted to allow loading a roll of bags into the interior of the housing, a transverse slot formed in the housing at the exterior end adapted to allow the dispensing of individual bags therethrough from the roll of bags from the interior of the housing to exterior thereof, the transverse slot separating the housing into an upper portion and the lower portion, end caps at the lateral ends of the slot to couple the upper portion and a lower portion, flanges in a plane extending downwardly and outwardly from the end caps and the upper and lower portions, the flanges adapted to be coupled to a bracket, lips formed in the upper portion and the lower portion of the housing on opposite sides of the slot, the lips being in a curvature in a direction opposite from the curvature of the remainder of the housing to guide the movement of individual bags through the slot, a finger formed in the center of the slot extending upwardly from the lower portion of the housing adapted to receive the slit in the bag at the region between adjacent bags to be separated, and a recess formed in the center of the slot extending upwardly in the upper portion of the housing adapted to receive the finger to assist in the separating of adjacent bags being dispensed; and the bracket having holes for mounting on a wall and outstanding supports at the lateral edges and across the bottom thereof for receiving the flanges and supporting the dispenser.

2. Apparatus for supporting, dispensing and separating bags from a roll of bags comprising:

a housing fabricated in a generally semi-cylindrical configuration with an interior end and an exterior end;

a transverse opening formed in the housing at the interior end adapted to allow the loading of a roll of bags into the interior of the housing;

a transverse slot formed in the housing at the exterior end adapted to allow the dispensing of individual bags therethrough from a roll of bags located interior of the housing to exterior thereof, the transverse slot separating the housing into a first portion and a second portion, the second portion having a greater radius of curvature than the first portion;

end caps at the lateral ends of the slot to couple the first portion and the second portion;

flanges in a plane extending outwardly from the end caps and the first and second portions for removably securing the housing to a support structure;

lips formed in the first portion and the second portion on opposite sides of the slot, the lips being in a curvature in a direction opposite from the curvature of the remainder of the housing;

a finger formed in the center of the slot extending from the second portion; and a recess formed in the center of the slot extending into the first portion adapted to receive the finger.

3. The apparatus as set forth in claim 2 wherein the housing is of a rigid one-piece construction.

4. The apparatus as set forth in claim 3 wherein the second portion of the housing extends outwardly from the interior end adjacent the slot a greater distance than the upper portion of the housing adjacent the slot.

5. A system for facilitating the sequential dispensing of individual bags from a roll comprising:

a roll of bags, the bags being formed together in a roll, each bag having perforations along the leading edge to facilitate its separation from the next following bag and an elongated slit centrally located between the perforations;

a dispenser for receiving and supporting the roll of bags comprising a housing of a generally semi-cylindrical configuration in cross section, the housing having an interior end and an exterior end, a transverse opening formed in the housing at its interior end, a transverse slot formed in the housing at its exterior end, with the transverse slot separating the housing into an upper portion and a lower portion, lips formed in the upper portion and the lower portion of the housing on opposite sides of the slot with the lips being in a curvature in cross section in a direction opposite from the curvature of the remainder of the housing, a finger formed in the center of the slot extending upwardly from the lower portion adapted to receive a slit in the region between adjacent bags, a recess formed in the center of the slot extending upwardly in the upper portion of the housing adapted to receive the finger, and flanges extending outwardly from the dispenser adjacent to the transverse opening; and a bracket adapted to receive and support the dispenser.

6. Apparatus for supporting, dispensing and separating bags from a roll of bags comprising:

a housing fabricated in a generally semi-cylindrical configuration with an interior end and an exterior end;

a transverse opening formed in the housing at the interior end adapted to allow the loading of a roll of bags into the interior of the housing;

a transverse slot formed in the housing at the exterior end adapted to allow the dispensing of individual bags therethrough from a roll of bags located interior of the housing to exterior thereof, the transverse slot separating the housing into a first portion and a second portion;

end caps at the lateral ends of the slot to couple the first portion and the second portion;

flanges in a plane extending outwardly from the end caps and the first and second portions for removably securing the housing to a support structure;

a curved recess formed in the center of the slot extending into the first portion; and a curved finger formed in the center of the slot extending from the second portion into the recess, the finger having a planar portion extending generally parallel with the slot and a ledge along the edge of the planar portion extending away from the interior end, the curves of the recess and finger forming an extension of the slot and with an additional curve formed perpendicularly with respect to the slot at the region where the ledge and planar portions join.

* * * * *